US010176771B2

(12) United States Patent
Tien et al.

(10) Patent No.: US 10,176,771 B2
(45) Date of Patent: Jan. 8, 2019

(54) DISPLAY PANEL AND METHOD FOR DRIVING DISPLAY PANEL BASED ON A FIRST AND SECOND GAMMA FUNCTION

(71) Applicant: AU OPTRONICS CORPORATION, Hsin-chu (TW)

(72) Inventors: Kun-Cheng Tien, Hsin-chu (TW); Shu-En Li, Hsin-chu (TW); Chien-Huang Liao, Hsin-chu (TW); Jia-Long Wu, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/490,218

(22) Filed: Apr. 18, 2017

(65) Prior Publication Data

US 2017/0330520 A1 Nov. 16, 2017

(30) Foreign Application Priority Data

May 12, 2016 (TW) ..... 105114642 A

(51) Int. Cl.
*G09G 5/02* (2006.01)
*G09G 3/36* (2006.01)

(52) U.S. Cl.
CPC ..... *G09G 3/3607* (2013.01); *G09G 3/3614* (2013.01); *G09G 3/3677* (2013.01);
(Continued)

(58) Field of Classification Search
CPC ... G09G 3/3607; G09G 3/3614; G09G 3/3677
(Continued)

(56) References Cited

U.S. PATENT DOCUMENTS 8,780,133 B2 7/2014 Jeong et al.
2009/0135207 A1 5/2009 Tseng et al.
(Continued)

FOREIGN PATENT DOCUMENTS

CN 105511187 A 4/2016
JP 2011007889 A 1/2011
TW 200923879 A 6/2009

OTHER PUBLICATIONS

Office Action issued by the State Intellectual Property Office of the Peoples Republic of China (SIPO) dated Feb. 26, 2018 for Chinese Application No. 201610556808.7.

*Primary Examiner* — Jonathan Blancha
(74) *Attorney, Agent, or Firm* — Tim Tingkang Xia, Esq.; Locke Lord LLP

(57) ABSTRACT

A display panel includes a pixel array, a gate driving circuit, and a data driving circuit. The pixel array includes a plurality of pixel blocks, a plurality of gate lines and a plurality of data lines. The gate driving circuit is electrically coupled to the gate lines for driving sub-pixels of the pixel array. The data driving circuit is electrically coupled to the data lines for providing data signals to the sub-pixels of the pixel array. The sub-pixels of each pixel block include a plurality of first sub-pixels and a plurality of second sub-pixels. For each pixel block, the first sub-pixels and the second sub-pixels have same quantity. For displaying a specified gray-scale value, a luminance value in each first sub-pixel is greater than a luminance value in each second sub-pixel. The data driving circuit changes a polarity of each sub-pixel of the pixel array by using a polarization sequence.

18 Claims, 9 Drawing Sheets

(52) U.S. Cl.
CPC ... *G09G 3/3688* (2013.01); *G09G 2300/0452* (2013.01); *G09G 2310/08* (2013.01); *G09G 2320/0209* (2013.01); *G09G 2320/0673* (2013.01)

(58) Field of Classification Search
USPC ..... 345/696
See application file for complete search history.

(56) References Cited

U.S. PATENT DOCUMENTS

| | | | | |
|---|---|---|---|---|
| 2014/0078125 | A1* | 3/2014 | Gondo | G09G 3/3614 345/209 |
| 2014/0168289 | A1* | 6/2014 | Shibata | G09G 3/3688 345/690 |
| 2016/0035292 | A1* | 2/2016 | Lee | G09G 3/3648 345/694 |
| 2016/0111050 | A1* | 4/2016 | Pyun | G09G 3/3607 345/694 |
| 2016/0370669 | A1* | 12/2016 | Mok | G09G 3/3614 |
| 2017/0221437 | A1 | 8/2017 | Xu et al. | |

* cited by examiner

| | | | | | | | |
|---|---|---|---|---|---|---|---|
| HP1 | HP2 | HP3 | HP4 | HP5 | HP6 | HP7 | HP8 |
| HP9 | HP10 | HP11 | HP12 | HP13 | HP14 | HP15 | HP16 |

FIG. 3

| | | | |
|---|---|---|---|
| ZP1 | ZP2 | ZP3 | ZP4 |
| ZP5 | ZP6 | ZP7 | ZP8 |
| ZP9 | ZP10 | ZP11 | ZP12 |
| ZP13 | ZP14 | ZP15 | ZP16 |

FIG. 4

DISPLAY PANEL AND METHOD FOR DRIVING DISPLAY PANEL BASED ON A FIRST AND SECOND GAMMA FUNCTION

CROSS-REFERENCE TO RELATED PATENT APPLICATION

This application claims the benefit of priority to Taiwan Patent Application No. 105114642, filed May 12, 2016. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to a display panel and a method for driving a display panel.

BACKGROUND

With the rapid development of technologies, different types of liquid crystal displays have been developed. The liquid crystal displays generally use liquid crystal display panels of various types such as a twisted nematic (TN)-type liquid crystal display panel, a vertical alignment (VA)-type liquid crystal display panel, and an in-plane switching-type liquid crystal display panel.

However, the issue of side-view color washout may occur when the existing VA-type liquid crystal display panel is viewed at a large viewing angle. The reason is that the light leakage phenomenon is not evident when the liquid crystal molecules of pixels in the VA-type liquid crystal display panel are viewed at a front-viewing angle; the light leakage becomes an evident phenomenon when these liquid crystal molecules are viewed at a side-viewing angle. In other words, the gamma curve may not be seriously distorted when the VA-type liquid crystal display panel is viewed at a front-viewing angle; yet it is seriously distorted, and for example, resulted in a Concave Function of the side-view gamma curve located above the front-view gamma curve, when viewed at a side-viewing angle. The distortion of the side-view gamma curve is more apparent at a low gray-scale level, and therefore the color washout phenomenon may occur in the luminance of the liquid crystal display panel when viewed at a side-viewing angle.

The method for solving the side-view color washout problem in the existing VA-type liquid crystal display panel is as follows: a single sub-pixel in the liquid crystal display panel is divided into two regions; a thin-film transistor (TFT) and a corresponding capacitor are used to divide a driving voltage, so as to drive the two regions using different voltages. Moreover, the two regions may have the same circuit area. The driving manner may be to turn on a first region (for example, a bright region) and then turn on a second region (for example, a dark region) of the single sub-pixel. After being properly designed, the front-view gamma curve of sub-pixels in the liquid crystal display panel may be maintained as the original gamma curve, and the distortion of the side-view gamma curve is reduced (for example, the difference between relative luminance ratios corresponding to the side-view and front-view gamma curves at a fixed gray-scale value is reduced). Therefore, the side-view color washout effect can be reduced by using the technology of segmenting a single sub-pixel into different regions in the existing VA-type liquid crystal display panel.

In the existing method for reducing the side-view color washout effect, the aperture ratio is decreased in the case that the circuit area of the sub-pixels is reduced (i.e., the pixel density of the liquid crystal display panel is increased). The aperture ratio is defined as dividing the luminous circuit area of the sub-pixels by the overall circuit area of the sub-pixels. The reason that the aperture ratio is reduced includes that when a single sub-pixel is divided into two regions, a voltage dividing circuit composed of a TFT and a corresponding capacitor is required to divide a driving voltage so as to drive the two regions separately. The voltage dividing circuit does not have the luminous characteristic, and therefore the presence of the voltage dividing circuit may result in the decrease of the aperture ratio.

SUMMARY

Certain embodiments is related to a display panel, comprising a pixel array, a gate driving circuit, and a data driving circuit. The pixel array includes a plurality of pixel blocks, a plurality of gate lines, and a plurality of data lines. Each of the plurality of pixel blocks includes a plurality of sub-pixels. Each of the plurality of gate lines is electrically coupled to the sub-pixels in the same row of the pixel array. Each of the plurality of data lines is electrically coupled to the sub-pixels in the same column of the pixel array. The gate driving circuit is electrically coupled to the gate lines, for driving the sub-pixels in the pixel array. The data driving circuit is electrically coupled to the data lines, for providing data signals to the sub-pixels in the pixel array. The sub-pixels in each pixel block include a plurality of first sub-pixels and a plurality of second sub-pixels, wherein a number of the plurality of first sub-pixels equals that of the plurality of second sub-pixels in each of the plurality of pixel blocks. The luminance value of each first sub-pixel is greater than that of each second sub-pixel. The data driving circuit changes the polarity of each sub-pixel in the pixel array through the data lines by using a polarization sequence having a cycle being greater than or equal to a numerical value. A red sub-pixel, a green sub-pixel, a blue sub-pixel, and a white sub-pixel in a first row of each of the plurality of pixel blocks are sequentially arranged from left to right; and a blue sub-pixel, a white sub-pixel, a red sub-pixel, and a green sub-pixel in a second row of each of the plurality of pixel blocks are sequentially arranged from left to right.

Certain embodiments are related to a display panel, comprising a pixel array, a gate driving circuit, and a data driving circuit. The pixel array includes a plurality of pixel blocks, a plurality of gate lines and a plurality of data lines. Each of the plurality of pixel blocks includes a plurality of sub-pixels. Each of the plurality of gate lines is electrically coupled to the sub-pixels in the same row of the pixel array. Each of the plurality of data lines is electrically coupled to the sub-pixels in the same column of the pixel array. The gate driving circuit is electrically coupled to the gate lines, for driving the sub-pixels in the pixel array. The data driving circuit is electrically coupled to the data lines, for providing data signals to the sub-pixels in the pixel array. The sub-pixels in each pixel block comprise a first to fourth sub-pixels sequentially arranged in one row in a first direction and a fifth to eighth sub-pixels sequentially arranged in another row in the first direction; the first and fifth sub-pixels are arranged in the same column, the second and sixth sub-pixels are arranged in the same column, the third and seventh sub-pixels are arranged in the same column, and the fourth and eighth sub-pixels are arranged in the same column; the first, second, third, and sixth sub-pixels are driven based on a first gamma function, and the fourth, fifth, seventh, and eighth sub-pixels are driven based on a second gamma function; and wherein the first gamma function and the second gamma function are predefined such that, when the first gamma function and the second gamma function are respectively provided to drive the corresponding sub-pixels to display a specified gray-scale value, a first luminance of the corresponding sub-pixels driven based on the first gamma function to display the specified gray-scale value is greater than a second luminance of the corresponding sub-pixels driven based on the second gamma function to display the specified gray-scale value.

Certain embodiments are related to a method for driving a display panel. The display panel comprises a pixel array, the pixel array includes a plurality of pixel blocks, wherein a first row of each pixel block includes a red sub-pixel, a green sub-pixel, a blue sub-pixel, and a white sub-pixel sequentially arranged from left to right, and a second row of each pixel block includes a blue sub-pixel, a white sub-pixel, a red sub-pixel, and a green sub-pixel sequentially arranged from left to right. The method for driving the display panel includes: driving a first sub-pixel, a second sub-pixel, a third sub-pixel, and a sixth sub-pixel in each pixel block based on a first gamma function; driving a fourth sub-pixel, a fifth sub-pixel, a seventh sub-pixel, and an eighth sub-pixel in each pixel block based on a second gamma function; and changing, by a data driving circuit in the display panel, the polarity of each sub-pixel in the pixel array by using a polarization sequence having a cycle being greater than or equal to a numerical value, wherein the first to fourth sub-pixels are sequentially arranged in one row in a first direction, the fifth to eighth sub-pixels are sequentially arranged in another row in the first direction; the first and fifth sub-pixels are arranged in the same column, the second and sixth sub-pixels are arranged in the same column, the third and seventh sub-pixels are arranged in the same column, and the fourth and eighth sub-pixels are arranged in the same column.

BRIEF DESCRIPTION OF THE DRAWINGS

FIG. 3 is a schematic drawing of the arrangement and combination of a first group when single-color sub-pixels are used in the display panel.

FIG. 4 is a schematic drawing of the arrangement and combination of a second group when single-color sub-pixels are used in the display panel.

DETAILED DESCRIPTION

Figure 1:
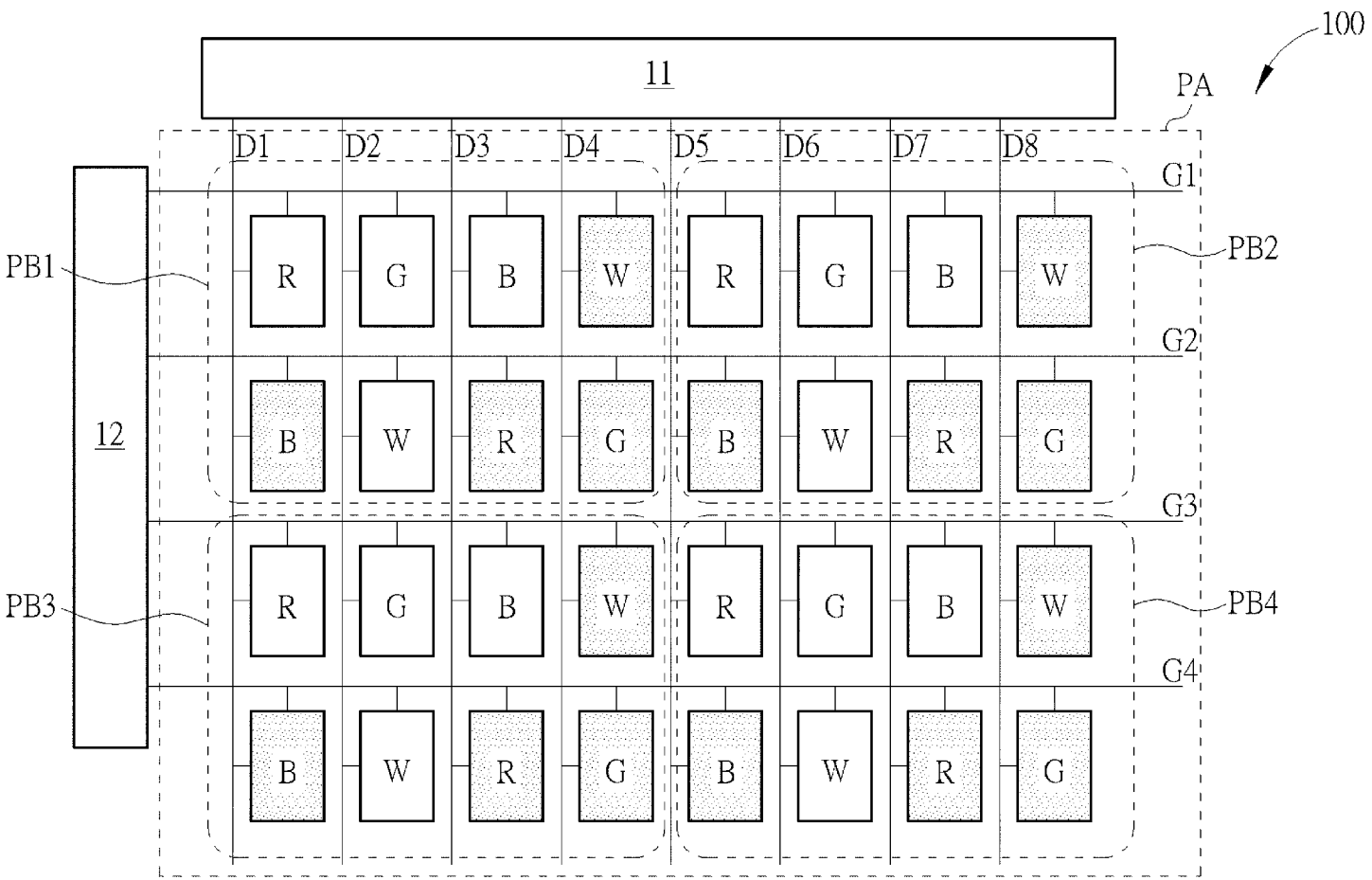
FIG. 1 is an architecture diagram of an embodiment of a display panel.

FIG. 1 is an architecture diagram of a display panel 100. The display panel 100 includes a pixel array PA, a gate driving circuit 12, and a data driving circuit 11. The pixel array PA may be a pixel array of $N_C \times N_R$ dimensions, wherein $N_C$ and $N_R$ are positive integers. For ease of description, in the present embodiment, the pixel array PA is a pixel array of 4×8 dimensions, but in reality the pixel array PA may have more pixels. The pixel array PA includes a plurality of pixel blocks PB1 to PB4, and each pixel block includes a plurality of sub-pixels. The pixel blocks PB1 to PB4 are the same pixel blocks, and the structure of a single pixel block is described in detail below. The pixel array PA also includes a plurality of gate lines G1 to G4 and a plurality of data lines D1 to D8. Each of the gate lines G1 to G4 is electrically coupled to the sub-pixels in the same row of the pixel array PA. For example, the gate line G1 is electrically coupled to the sub-pixels in a first row of the pixel array PA; the gate line G2 is electrically coupled to the sub-pixels in a second row of the pixel array PA; the gate line G3 is electrically coupled to the sub-pixels in a third row of the pixel array PA; and the gate line G4 is electrically coupled to the sub-pixels in a fourth row of the pixel array PA. Each of the data lines D1 to D8 is electrically coupled to the sub-pixels in the same column of the pixel array PA. For example, the data line D1 is electrically coupled to the sub-pixels in a first column of the pixel array PA; the data line D2 is electrically coupled to the sub-pixels in a second column of the pixel array PA; and the rest may be deduced by analogy. The gate driving circuit 12 is electrically coupled to the gate lines G1 to G4, for driving all the sub-pixels in the pixel array PA. The data driving circuit 11 is electrically coupled to the data lines D1 to D8, for providing data signals to all the sub-pixels in the pixel array PA. It is noted that the term "electrically coupled" or other similar terms, depending on the spirit of the embodiments, can be referred to directly electrically coupled and/or indirectly electrically coupled. In addition, the term "each" it is not always intend to mean all elements on a device exhibit a specific characteristic, and instead, it can mean that all the elements in a specific sub-region of the device exhibit the specific characteristic.

Figure 2A:
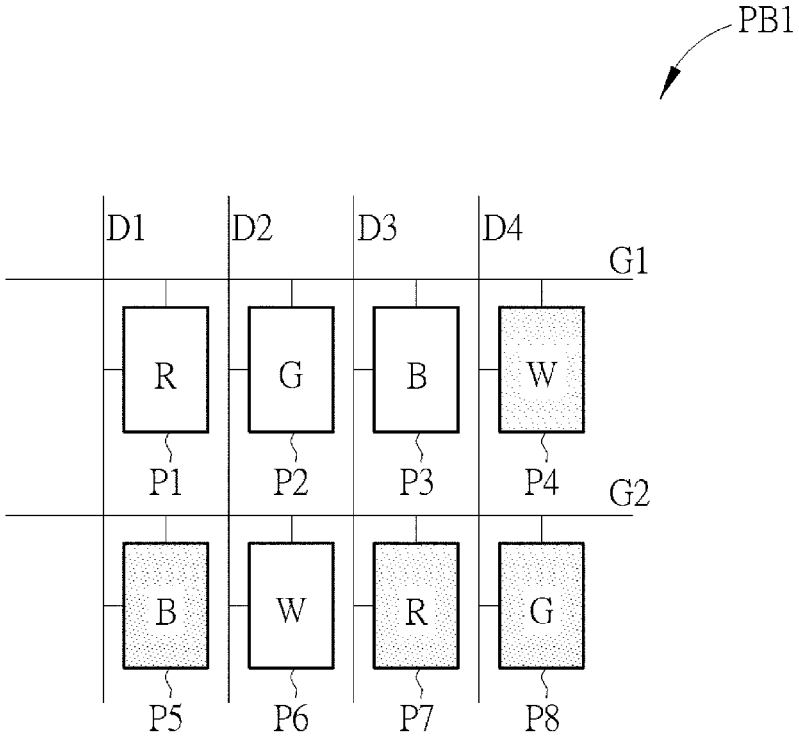
FIG. 2A is an architecture diagram of a pixel block in the display panel of FIG. 1.

FIG. 2A is an architecture diagram of the pixel block PB1 in the display panel 100. Because the pixel blocks PB1 to PB4 in the display panel 100 represent four identical pixel blocks, for ease of description, the pixel block PB1 is used as an example for illustration in FIG. 2A. The pixel block PB1 is a 2×4 pixel array; in other words, the pixel block PB1 has eight sub-pixels. The eight sub-pixels include a sub-pixel P1, a sub-pixel P2, a sub-pixel P3, and a sub-pixel P4 from left to right in a first row, and a sub-pixel P5, a sub-pixel P6, a sub-pixel P7, and a sub-pixel P8 from left to right in a second row. Moreover, the sub-pixel P1 and the sub-pixel P5 are in the same column (a first column); the sub-pixel P2 and the sub-pixel P6 are in the same column (a second column); the sub-pixel P3 and the sub-pixel P7 are in the same column (a third column); and the sub-pixel P4 and the sub-pixel P8 are in the same column (a fourth column). The eight sub-pixels P1 to P8 may also be divided into a plurality of first sub-pixels and a plurality of second sub-pixels, with each having the same quantity. Herein, the first sub-pixels include the sub-pixel P1, the sub-pixel P2, the sub-pixel P3, and the sub-pixel P6. The second sub-pixels include the sub-pixel P4, the sub-pixel P5, the sub-pixel P7, and the sub-pixel P8. The sub-pixel P1, the sub-pixel P2, the sub-pixel P3, and the sub-pixel P4 are located in the first row of the pixel block PB1, and are electrically coupled to the gate line G1. The sub-pixel P5, the sub-pixel P6, the sub-pixel P7, and the sub-pixel P8 are located in the second row of the pixel block PB1, and are electrically coupled to the gate line G2. The sub-pixel P1 and the sub-pixel P5 are located in the first column of the pixel block PB1, and are electrically coupled to the data line D1. The sub-pixel P2 and the sub-pixel P6 are located in the second column of the pixel block PB1, and are electrically coupled to the data line D2. The sub-pixel P3 and the sub-pixel P7 are located in the third column of the pixel block PB1, and are electrically coupled to the data line D3. The sub-pixel P4 and the sub-pixel P8 are located in the fourth column of the pixel block PB1, and are electrically coupled to the data line D4. Moreover, the sub-pixel P1 is a red sub-pixel; the sub-pixel P2 is a green sub-pixel; the sub-pixel P3 is a blue sub-pixel; the sub-pixel P4 is a white sub-pixel; the sub-pixel P5 is a blue sub-pixel; the sub-pixel P6 is a white sub-pixel; the sub-pixel P7 is a red sub-pixel; and the sub-pixel P8 is a green sub-pixel. In addition, the pixel block PB1 is adjacent to the pixel blocks PB2 and PB3; the pixel block PB2 is adjacent to the pixel blocks PB1 and PB4; the pixel block PB3 is adjacent to the pixel blocks PB1 and PB4; and the pixel block PB4 is adjacent to the pixel blocks PB2 and PB3. The definition of the pixel blocks being adjacent is that some sub-pixels in two pixel blocks are adjacent to each other. For example, as shown in FIG. 1, a sub-pixel in the first row and the first column of the pixel block PB4 is adjacent to a white sub-pixel (in the first row and the fourth column) of the pixel block PB3 since there is no other sub-pixel located therebetween; and a sub-pixel in the second row and the first column of the pixel block PB4 is adjacent to a green sub-pixel (in the second row and the fourth column) of the pixel block PB3.

Figure 2B:
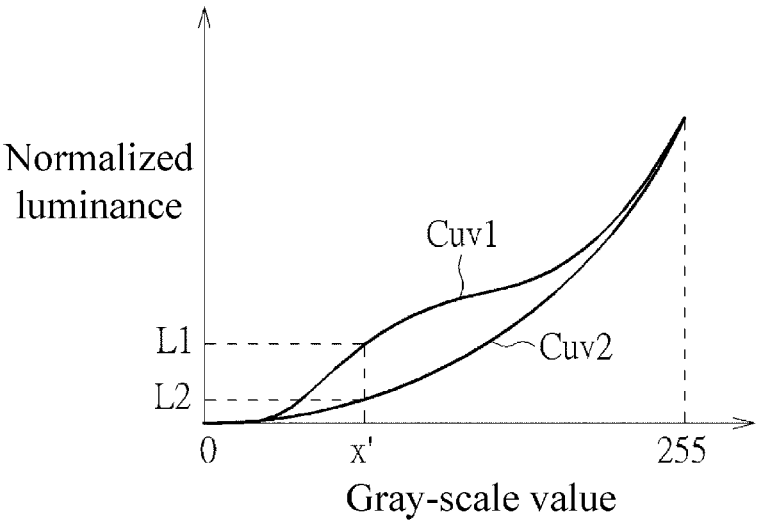
FIG. 2B is a schematic drawing of a gamma function corresponding to the pixel block in the display panel of FIG. 1.

In the pixel block PB1, under the same gray-scale instruction, the luminance value of each of the first sub-pixels (including the sub-pixel P1, the sub-pixel P2, the sub-pixel P3, and the sub-pixel P6) is greater than that of each of the second sub-pixels (including the sub-pixel P4, the sub-pixel P5, the sub-pixel P7, and the sub-pixel P8). In other words, if a gray-scale instruction is sent to the pixel block PB1 for driving the sub-pixels, a display system performs mapping on the gray-scale instruction based on two or more gamma functions, to find out the actual gamma function used for driving the sub-pixels P1 to P8. Please refer to FIG. 2B, a schematic drawing of a gamma function corresponding to the pixel block PB1 in the display panel 100. The solid line Cuv1 represents a first gamma function corresponding to the sub-pixel P1, the sub-pixel P2, the sub-pixel P3, and the sub-pixel P6; and the solid line Cuv2 represents a second gamma function corresponding to the sub-pixel P4, the sub-pixel P5, the sub-pixel P7, and the sub-pixel P8. The X-axis represents the gray-scale value, whereas the Y-axis represents normalized display luminance. In FIG. 2B, regarding a specified gray-scale value x' corresponding to a gray-scale instruction, the first gamma function Cuv1 and the second gamma function Cuv2 correspond to different luminance; for example, the first gamma function Cuv1 corresponds to the luminance L1, and the second gamma function Cuv2 corresponds to the luminance L2. Therefore, when the sub-pixel P1, the sub-pixel P2, the sub-pixel P3, and the sub-pixel P6 are driven by using the first gamma function Cuv1, higher luminance values are presented. When the sub-pixel P4, the sub-pixel P5, the sub-pixel P7, and the sub-pixel P8 are driven by using the second gamma function Cuv2, lower luminance values are presented. The pixels of the display panel 100 are driven by using the gamma function Cuv1 and the gamma function Cuv2; therefore, after the first gamma function Cuv1 and the second gamma function Cuv2 are properly designed, the difference of luminance presented at a side-viewing angle and a front-viewing angle under the same gray-scale value can be reduced, thereby improving the side-view color washout. It is particularly noted that the characteristics of the first gamma function Cuv1 and the second gamma function Cuv2 are nearly the same in an extreme gray-scale value range. As shown in FIG. 2B, the first gamma function Cuv1 and the second gamma function Cuv2 may be nearly the same in a range of low gray-scale values (for example, from a gray-scale value 0 to a gray-scale value 5), and therefore the luminance presented by the first sub-pixels is nearly the same as the luminance presented by the second sub-pixels. Moreover, the first gamma function Cuv1 and the second gamma function Cuv2 may be nearly the same in a range of high gray-scale values (for example, from a gray-scale value 250 to a gray-scale value 255), and therefore the luminance presented by the first sub-pixels is nearly the same as the luminance presented by the second sub-pixels. Therefore, specifically, the luminance of the first sub-pixels driven based on the first gamma function Cuv1 is greater than or nearly equal to that of the second sub-pixels driven based on the second gamma function Cuv2. In the pixel array PA of the display panel 100, the pixel block PB1 to the pixel block PB4 are identical pixel blocks; therefore, the relative configuration and physical characteristics of the eight sub-pixels in each pixel block are the same. Moreover, the data driving circuit 11 of the display panel 100 may change the polarity of each sub-pixel in the pixel array PA through the data lines D1 to D8 by using a polarization sequence with a cycle being greater than or equal to a numerical value. The polarization sequence may be properly designed to reduce the horizontal crosstalk effect in the display panel 100. The vertical crosstalk effect may be further reduced by using an N-line dot inversion algorithm in the display panel 100. The relative positions and luminance configuration design of the sub-pixels in the pixel block PB1 to the pixel block PB4 in the display panel 100 can reduce the side-view color washout phenomenon. The the driving manner will be illustrated in detail below. Moreover, how to design the polarization sequence to reduce the horizontal crosstalk effect and further reduce the vertical crosstalk effect by using the N-line dot inversion algorithm will also be illustrated in detail in what follows.

The configuration steps, and processes of the sub-pixels in the display panel 100 will be described below with the accompanying drawings. FIG. 3 is a schematic drawing of the arrangement and combination of a first group when single-color sub-pixels are used in the certain embodiments. Before the relative luminance of the sub-pixels in the display panel 100 is configured, the arrangement and combination of the first group of the single-color sub-pixels needs to be considered first. In the present embodiment, the considered single-color sub-pixels may be red sub-pixels in the display panel 100. The arrangement and combination of the first group may be one corresponding to a pixel block of 2×8 dimensions in the display panel 100. As shown in FIG. 3, the pixel block of 2×8 dimensions altogether has 16 sub-pixels, including a sub-pixel HP1 to a sub-pixel HP16. If the color configuration relationship of the sub-pixels in the display panel 100 is of concern, the red sub-pixels in the pixel block shown in FIG. 3 are the sub-pixel HP1, the sub-pixel HP5, the sub-pixel HP11, and the sub-pixel HP15. Moreover, three brightness configuration modes of the red sub-pixels in the pixel block in FIG. 3 may be considered. In the first configuration mode, the sub-pixel HP1 is a bright red sub-pixel; the sub-pixel HP5 is a bright red sub-pixel; the sub-pixel HP11 is a dark red sub-pixel; and the sub-pixel HP15 is a dark red sub-pixel. In the second configuration mode, the sub-pixel HP1 is a bright red sub-pixel; the sub-pixel HP5 is a dark red sub-pixel; the sub-pixel HP11 is a bright red sub-pixel; and the sub-pixel HP15 is a dark red sub-pixel. In the third configuration mode, the sub-pixel HP1 is a bright red sub-pixel; the sub-pixel HP5 is a dark red sub-pixel; the sub-pixel HP11 is a dark red sub-pixel; and the sub-pixel HP15 is a bright red sub-pixel. While the brightness of the picture is uniformly distributed in the first configuration mode, undesired straight stripe contrast appears in the pictures in the second and third configuration modes. Therefore, in the arrangement and combination of the first group of single-color sub-pixels, the first configuration mode is an optimal configuration mode (the sub-pixel HP1 and the sub-pixel HP5 are bright red sub-pixels, and the sub-pixel HP11 and the sub-pixel HP15 are dark red sub-pixels).

Next, an arrangement and combination of a second group of the single-color sub-pixels is considered. FIG. 4 is a schematic drawing of the arrangement and combination of a second group when single-color sub-pixels are used. Similar to the comparison mode in FIG. 3, the considered single-color sub-pixels may be red sub-pixels in the display panel 100. The arrangement and combination of the second group may be one corresponding to a pixel block of 4×4 dimensions in the display panel 100. As shown in FIG. 4, the pixel block of 4×4 dimensions altogether has 16 sub-pixels, including a sub-pixel ZP1 to a sub-pixel ZP16. If the color configuration relationship of the sub-pixels in the display panel 100 is of concern, the red sub-pixels in the pixel block shown in FIG. 4 are the sub-pixel ZP1, the sub-pixel ZP7, the sub-pixel ZP9, and the sub-pixel ZP15. Moreover, three brightness configuration modes of the red sub-pixels in the pixel block in FIG. 4 may be considered. In the first configuration mode, the sub-pixel ZP1 is a bright red sub-pixel; the sub-pixel ZP7 is a dark red sub-pixel; the sub-pixel ZP9 is a bright red sub-pixel; and the sub-pixel ZP15 is a dark red sub-pixel. In the second configuration mode, the sub-pixel ZP1 is a bright red sub-pixel; the sub-pixel ZP7 is a bright red sub-pixel; the sub-pixel ZP9 is a dark red sub-pixel; and the sub-pixel ZP15 is a dark red sub-pixel. In the third configuration mode, the sub-pixel ZP1 is a bright red sub-pixel; the sub-pixel ZP7 is a dark red sub-pixel; the sub-pixel ZP9 is a dark red sub-pixel; and the sub-pixel ZP15 is a bright red sub-pixel. While the brightness of the picture is uniformly distributed in the first configuration mode, undesired horizontal stripe contrast appears in the pictures in the second and third configuration modes. Therefore, in the arrangement and combination of the second group of the single-color sub-pixels, the first configuration mode is an optimal configuration mode (the sub-pixel ZP1 and the sub-pixel ZP9 are bright red sub-pixels, and the sub-pixel ZP7 and the sub-pixel ZP15 are dark red sub-pixels).

Besides, the first configuration mode of the arrangement and combination of the first group and the first configuration mode of that of the second group of the single-color sub-pixels are the same arrangement method. The identical part is that, if a pixel block of 2×4 dimensions is considered, the first red sub-pixel, counted from left to right in the first row, is a bright sub-pixel, and the third red sub-pixel, counted from left to right in the second row, is a dark sub-pixel. Therefore, regarding the single-color sub-pixels, in the pixel block of 2×4 dimensions, the optimal brightness configuration manner is the one described above. That is one of the reasons as to why the red sub-pixel P1 is configured as a bright sub-pixel and the red sub-pixel P7 is configured as a dark sub-pixel in the pixel block PB1 in FIG. 2A.

After the optimal relative luminance configuration of the single-color sub-pixels (red) is completed, if the color arrangement of the sub-pixels in the pixel block PB1 is of concern, the relative luminance configuration of the remaining sub-pixels merely has eight combinations ($2^3$=8). Please refer to the marks of the sub-pixels in FIG. 2A for comparison. Under the condition that the red sub-pixel P1 is configured as a bright sub-pixel and the red sub-pixel P7 is configured as a dark sub-pixel, in the first combination, the sub-pixel P2, the sub-pixel P3, and the sub-pixel P4 are bright sub-pixels, whereas the sub-pixel P5, the sub-pixel P6, and the sub-pixel P8 are dark sub-pixels. In the second combination, the sub-pixel P2, the sub-pixel P3, and the sub-pixel P6 are bright sub-pixels, whereas the sub-pixel P4, the sub-pixel P5, and the sub-pixel P8 are dark sub-pixels. In the third combination, the sub-pixel P2, the sub-pixel P4, and the sub-pixel P5 are bright sub-pixels, whereas the sub-pixel P3, the sub-pixel P6, and the sub-pixel P8 are dark sub-pixels. In the fourth combination, the sub-pixel P2, the sub-pixel P5 and the sub-pixel P6 are bright sub-pixels, whereas the sub-pixel P3, the sub-pixel P4, and the sub-pixel P8 are dark sub-pixels. In the fifth combination, the sub-pixel P3, the sub-pixel P4 and the sub-pixel P8 are bright sub-pixels, whereas the sub-pixel P2, the sub-pixel P5, and the sub-pixel P6 are dark sub-pixels. In the sixth combination, the sub-pixel P3, the sub-pixel P6 and the sub-pixel P8 are bright sub-pixels, whereas the sub-pixel P2, the sub-pixel P4, and the sub-pixel P5 are dark sub-pixels. In the seventh combination, the sub-pixel P4, the sub-pixel P5 and the sub-pixel P8 are bright sub-pixels, whereas the sub-pixel P2, the sub-pixel P3, and the sub-pixel P6 are dark sub-pixels. In the eighth combination, the sub-pixel P5, the sub-pixel P6 and the sub-pixel P8 are bright sub-pixels, whereas the sub-pixel P2, the sub-pixel P3, and the sub-pixel P4 are dark sub-pixels. In these eight combinations, the second combination has the most uniform brightness distribution. Therefore, after the optimal relative luminance configuration of the single-color sub-pixels (red) is completed, the bright/dark positions of the remaining sub-pixels can be configured by using the above second combination. The optimal solution of the luminance configuration of the sub-pixels in the pixel block of 2×4 dimensions, therefore, is that the sub-pixel P1, the sub-pixel P2, the sub-pixel P3, and the sub-pixel P6 are configured as bright sub-pixels, and the sub-pixel P4, the sub-pixel P5, the sub-pixel P7, and the sub-pixel P8 are configured as dark sub-pixels. That is the reason as to why the brightness of the eight sub-pixels in the pixel block PB1 in FIG. 2A is configured in this way.

After the sub-pixels in the pixel blocks PB1 to PB4 in the display panel 100 are configured in the above manner, the display panel 100 can display a more uniform hue, and the side-view color washout phenomenon can be improved. However, to further increase the display quality, the data driving circuit 11 of the display panel 100 may change the polarity of each sub-pixel in the pixel array PA through the data lines D1 to D8 by using a polarization sequence with a cycle being greater than or equal to a numerical value. The design of the polarization sequence is described below.

Theoretically, the display panel 100 can be driven by using a polarization sequence of any cycle; for example, a polarization sequence 'positive-negative-positive-negative-positive-negative-positive-negative' with a cycle being 2; a polarization sequence 'positive-positive-negative-negative-positive-positive-negative-negative' with a cycle being 4; or a polarization sequence 'positive-negative-negative-positive-negative-positive-positive-negative' or 'positive-negative-positive-positive-negative-positive-negative-negative' with a cycle being 8. In certain embodiments, the cycle of the polarization sequence is defined as a corresponding length of the sequence, by which the polarities change repeatedly. For example, in the polarization sequence 'positive-negative-positive-negative-positive-negative-positive-negative', the polarities periodically change by a length being 2, i.e., 'positive-negative'; in the polarization sequence 'positive-positive-negative-negative-positive-positive-negative-negative', the polarities periodically change by a length being 4, i.e., 'positive-positive-negative-negative'. However, if the cycle of the polarization sequence is too small, the horizontal crosstalk effect is produced when the polarization sequence is applied in the display panel 100. Details are given below.

Figure 5:
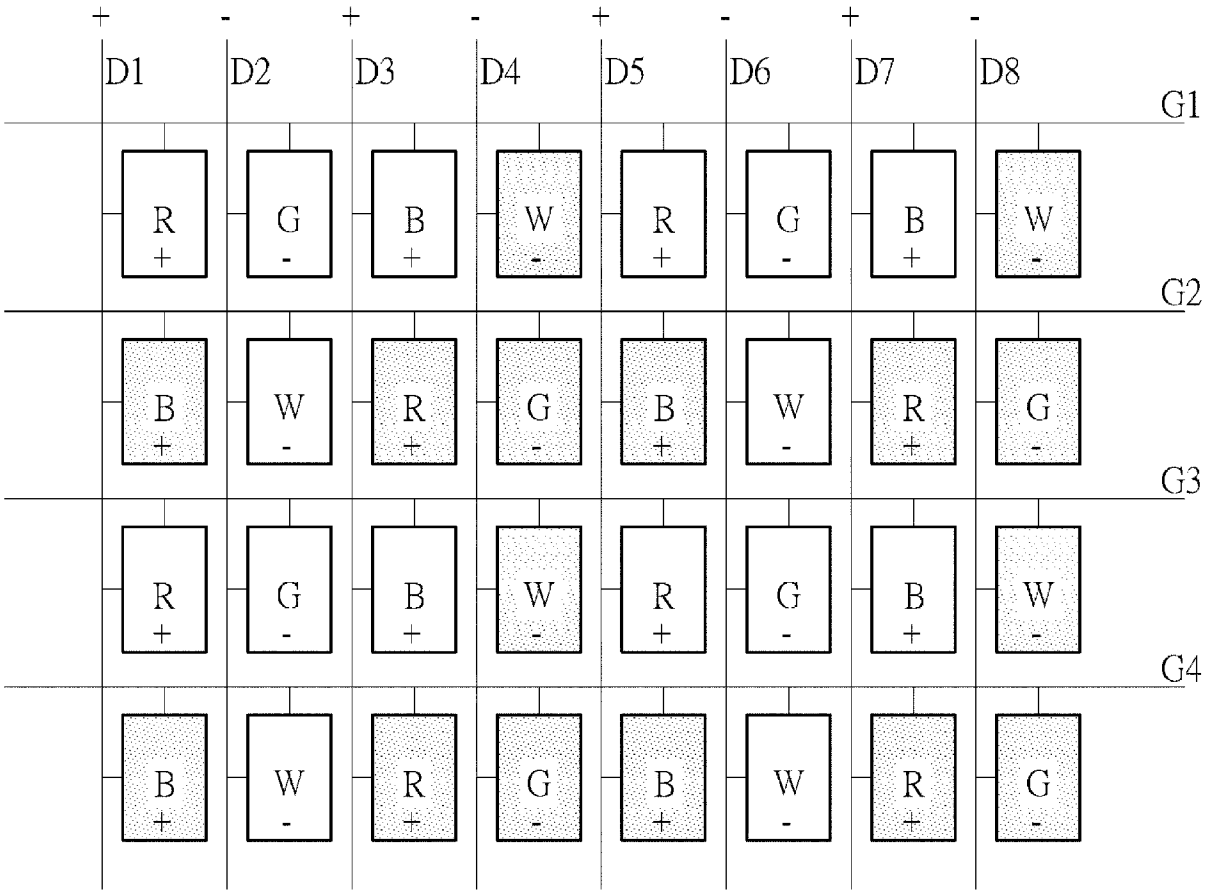
FIG. 5 is a schematic drawing of a polarization sequence with a cycle being 2 in the display panel.

FIG. 5 is a schematic drawing of a polarization sequence 'positive-negative-positive-negative-positive-negative-positive-negative' with a cycle being 2 is used in the display panel 100. In FIG. 5, the polarities of some bright sub-pixels (the sub-pixels corresponding to the data lines D1, D3, D5, and D7) on the first gate line G1 become positive; the polarities of some other bright sub-pixels (the sub-pixels corresponding to the data lines D2 and D6) become negative; and the polarities of the dark sub-pixels (the sub-pixels corresponding to the data lines D4 and D8) become negative. In other words, on the first gate line G1, the quantity of the bright sub-pixels in the positive polarity (quantity=4) is unequal to the quantity of the bright sub-pixels in the negative polarity (quantity=2). The quantity of the dark sub-pixels in the positive polarity (quantity=0) is unequal to the quantity of the dark sub-pixels in the negative polarity (quantity=2). Therefore, the common voltage for driving the sub-pixels may be deviated and the common voltage waveform may be further distorted because of the number differences in different polarities of the bright or dark sub-pixels. For example, the common voltage waveform may deviate toward the voltage in the positive polarity; therefore, the cross-voltage of the bright sub-pixels is reduced, and the cross-voltage of the dark sub-pixels is increased, leading to a severe horizontal crosstalk effect. In this case, in the present embodiment, a polarization sequence with a cycle being greater than or equal to 8 is selected in the display panel 100; for example, a polarization sequence 'positive-negative-negative-positive-negative-positive-positive-negative' or 'positive-negative-positive-positive-negative-positive-negative-negative' is selected. The description of a polarization sequence with a cycle being 8 is selected in the display panel 100 is given below.

Figure 6:
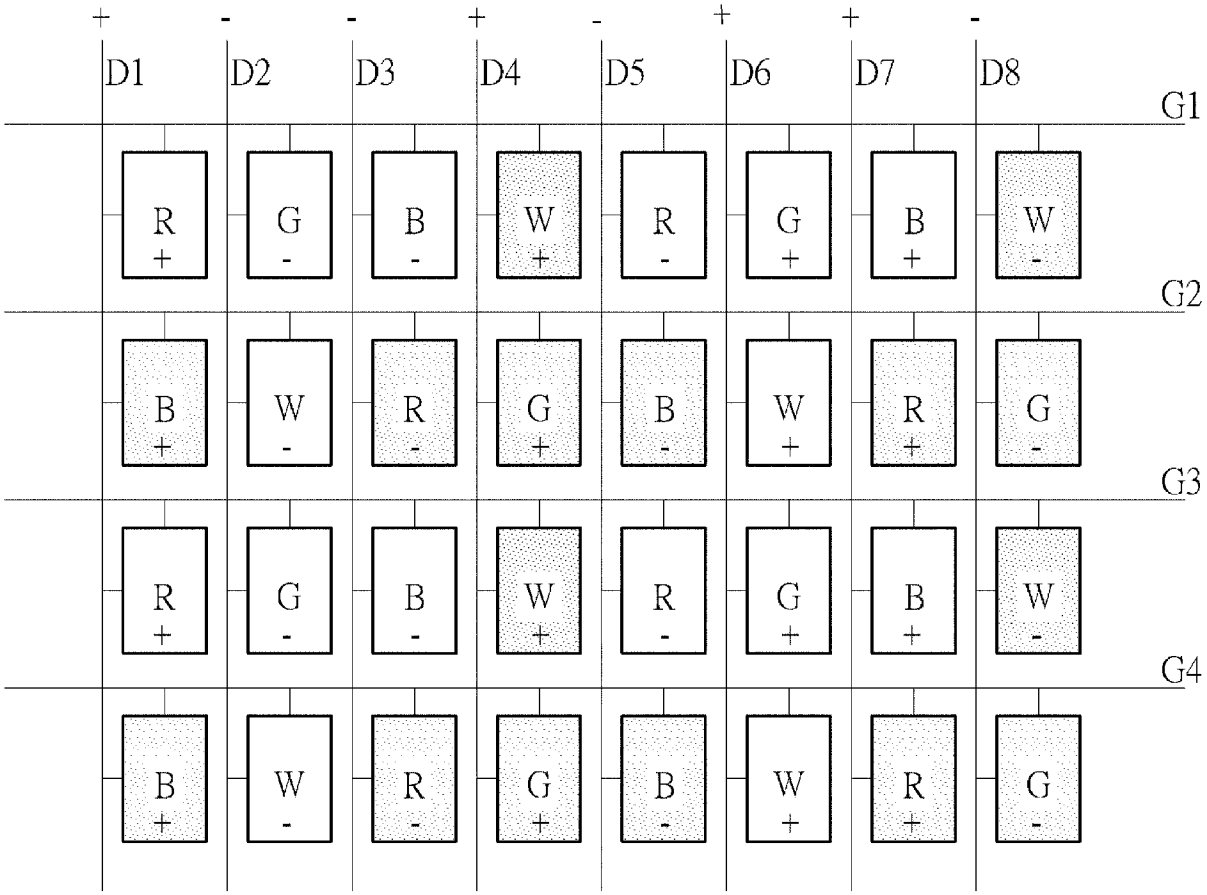
FIG. 6 is a schematic drawing of a first type of polarization sequence with a cycle being 8 in the display panel.

FIG. 6 is a schematic drawing of a first type of polarization sequence with a cycle being 8 in the display panel 100. The first polarization sequence is defined as a polarization sequence with the following sequence 'positive-negative-negative-positive-negative-positive-positive-negative'. In FIG. 6, in the same image frame, the polarities of some bright sub-pixels (the sub-pixels corresponding to the data lines D1, D6 and D7) on the first gate line G1 become positive; the polarities of some other bright sub-pixels (the sub-pixels corresponding to the data lines D2, D3 and D5) become negative; the polarities of some dark sub-pixels (the sub-pixels corresponding to the data line D4) become positive; and the polarities of some other dark sub-pixels (the sub-pixels corresponding to the data line D8) become negative. In other words, on the first gate line G1, the quantity of the bright sub-pixels in the positive polarity (quantity=3) is equal to the quantity of the bright sub-pixels in the negative polarity (quantity=3); and the quantity of the dark sub-pixels in the positive polarity (quantity=1) is equal to the quantity of the dark sub-pixels in the negative polarity (quantity=1). On the second gate line G2, the polarities of some bright sub-pixels (the sub-pixels corresponding to the data line D6) become positive; the polarities of some other bright sub-pixels (the sub-pixels corresponding to the data line D2) become negative; the polarities of some dark sub-pixels (the sub-pixels corresponding to the data lines D1, D4, and D7) become positive; and the polarities of some other dark sub-pixels (the sub-pixels corresponding to the data lines D3, D5, and D8) become negative. In other words, on the second gate line G2, the quantity of the bright sub-pixels in the positive polarity (quantity=1) is equal to the quantity of the bright sub-pixels in the negative polarity (quantity=1); and the quantity of the dark sub-pixels in the positive polarity (quantity=3) is equal to the quantity of the dark sub-pixels in the negative polarity (quantity=3). The condition of the third gate line G3 is the same as that of the first gate line G1; and the condition of the fourth gate line G4 is the same as that of the second gate line G2. Therefore, after the polarization sequence 'positive-negative-negative-positive-negative-positive-positive-negative' with a cycle being 8 is considered in the display panel 100, because both the bright and dark sub-pixels in different polarities have the same quantities in the same row, the horizontal crosstalk effect can be reduced.

Figure 7:
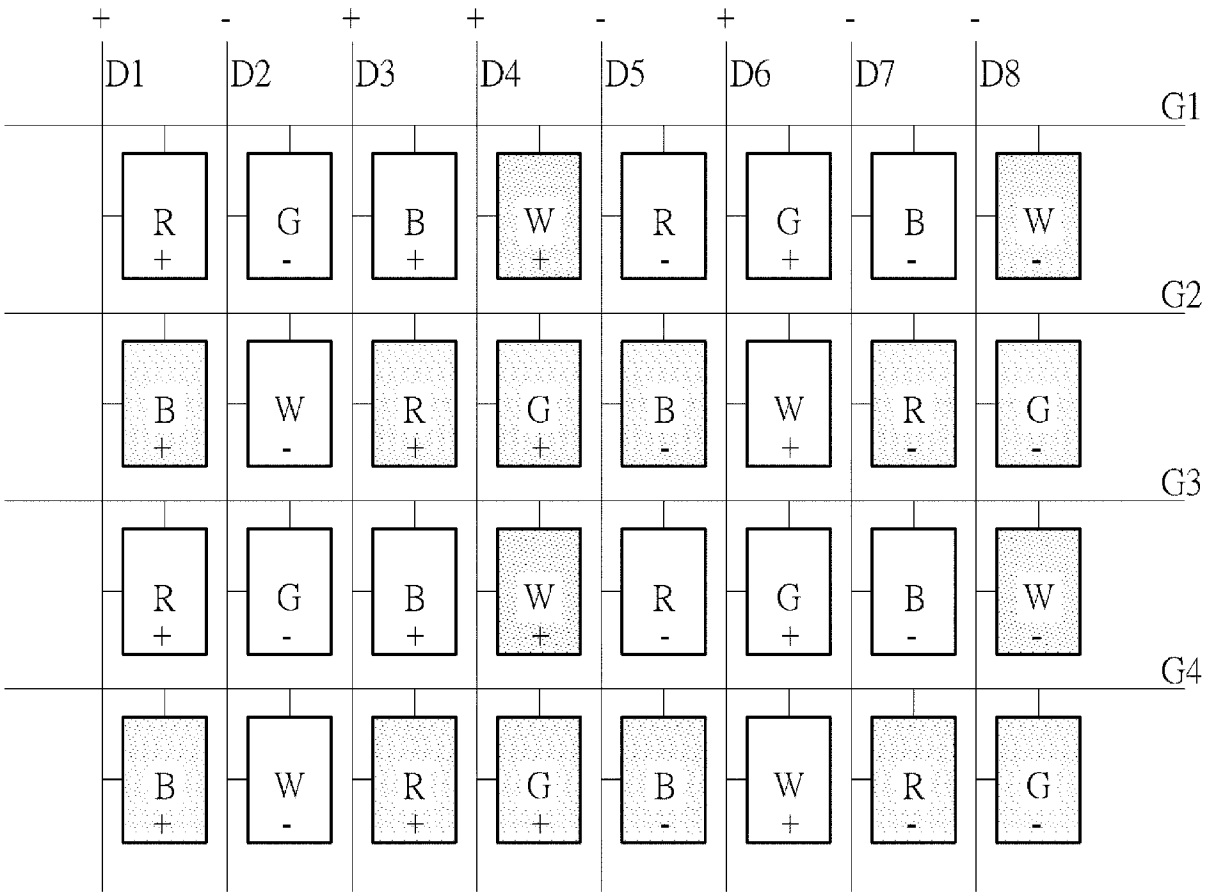
FIG. 7 is a schematic drawing of a second type of polarization sequence with a cycle being 8 in the display panel.

FIG. 7 is a schematic drawing of a second type of polarization sequence with a cycle being 8 in the display panel. The second polarization sequence is defined as a polarization sequence with the following sequence 'positive-negative-positive-positive-negative-positive-negative-negative'. In FIG. 7, in the same image frame, the polarities of some bright sub-pixels (the sub-pixels corresponding to the data lines D1, D3, and D6) on the first gate line G1 become positive; the polarities of some other bright sub-pixels (the sub-pixels corresponding to the data lines D2, D5, and D7) become negative; the polarities of some dark sub-pixels (the sub-pixels corresponding to the data line D4) become positive; and the polarities of some other dark sub-pixels (the sub-pixels corresponding to the data line D8) become negative. In other words, on the first gate line G1, the quantity of the bright sub-pixels in the positive polarity (the quantity=3) is equal to the quantity of the bright sub-pixels in the negative polarity (the quantity=3); and the quantity of the dark sub-pixels in the positive polarity (the quantity=1) is equal to the quantity of the dark sub-pixels in the negative polarity (the quantity=1). On the second gate line G2, the polarities of some bright sub-pixels (the sub-pixels corresponding to the data line D6) become positive; the polarities of some other bright sub-pixels (the sub-pixels corresponding to the data line D2) become negative, the polarities of some dark sub-pixels (the sub-pixels corresponding to the data lines D1, D3, and D4) become positive; and the polarities of some other dark sub-pixels (the sub-pixels corresponding to the data lines D5, D7, and D8)

become negative. In other words, on the second gate line G2, the quantity of the bright sub-pixels in the positive polarity (the quantity=1) is equal to the quantity of the bright sub-pixels in the negative polarity (the quantity=1); and the quantity of the dark sub-pixels in the positive polarity (the quantity=3) is equal to the quantity of the dark sub-pixels in the negative polarity (the quantity=3). The condition of the third gate line G3 is the same as that of the first gate line G1; and the condition of the fourth gate line G4 is the same as that of the second gate line G2. Therefore, after the polarization sequence 'positive-negative-positive-positive-negative-positive-negative-negative' with a cycle being 8 is considered in the display panel 100, because both the bright and dark sub-pixels in different polarities have the same quantities in the same row, the horizontal crosstalk effect can be reduced.

In the certain embodiments, the cycle length of the polarization sequence considered in the display panel 100 is not limited to 8, and the used polarization sequence is not limited to those shown in FIG. 6 and FIG. 7. For example, any polarization sequence with a cycle being greater than or equal to 8 and satisfying the condition that both the bright and dark sub-pixels in different polarities have the same quantities in the same row of the pixel array PA is applicable to the display panel 100, which reduces the horizontal crosstalk effect. In a broader sense, the polarization sequence considered in the display panel 100 may be of any polarization sequence with a cycle being greater than 8, such as 'positive-negative-positive-positive-negative-positive-negative-negative', 'positive-positive-negative-positive-negative-negative-positive-negative' or 'positive-negative-negative-positive-negative-positive-positive-negative'.

When the polarization sequence 'positive-negative-positive-positive-negative-positive-negative-negative' is used in the display panel 100, the sequentially-arranged sub-pixels from left to right in the first row of the pixel block PB1 are the red sub-pixel having a first polarity; the green sub-pixel having a second polarity; the blue sub-pixel having the first polarity; and the white sub-pixel having the first polarity. The sequentially-arranged sub-pixels from left to right in the second row of the pixel block PB1 are the blue sub-pixel having the first polarity; the white sub-pixel having the second polarity; the red sub-pixel having the first polarity; and the green sub-pixel having the first polarity. In the pixel blocks PB1 and PB3, the first polarity is defined as the positive polarity, whereas the second polarity is defined as the negative polarity. In the pixel blocks PB2 and PB4, the first polarity is defined as the negative polarity, while the second polarity is defined as the positive polarity. When the polarization sequence 'positive-positive-negative-positive-negative-negative-positive-negative' is used in the display panel 100, the sequentially-arranged sub-pixels from left to right in the first row of the pixel block PB1 are the red sub-pixel having the first polarity; the green sub-pixel having the first polarity; the blue sub-pixel having the second polarity; and the white sub-pixel having the first polarity. The sequentially-arranged sub-pixels from left to right in the second row of the pixel block PB1 are the blue sub-pixel having the first polarity; the white sub-pixel having the first polarity; the red sub-pixel having the second polarity; and the green sub-pixel having the first polarity. In the pixel blocks PB1 and PB3, the first polarity is defined as the positive polarity, whereas the second polarity is defined as the negative polarity. In the pixel blocks PB2 and PB4, the first polarity is defined as the negative polarity, while the second polarity is defined as the positive polarity. The rest may be deduced by analogy. However, the polarization sequence used in FIG. 7 is 'positive-negative-positive-positive-negative-positive-negative-negative'. In this way, the data lines in the same polarity may only be found on two sides of the red sub-pixel and the blue sub-pixel in the pixel array PA. In other words, in the polarization sequence used in FIG. 7, the data lines on two sides of each green sub-pixel in the pixel array PA will definitely have different polarities. Therefore, when the data lines on two sides of each green sub-pixel in the pixel array PA have different polarities, the coupling voltage in the positive polarity of the data line on one side of each green sub-pixel in the duration of one image frame is nearly equal to the coupling voltage in the negative polarity of the data line on the other side; therefore, the average value of the driving voltages of the green sub-pixels remains stable. In other words, when the data lines on two sides of each green sub-pixel in the pixel array PA have different polarities, the driving voltage may not be increased and thus the abnormal brightening phenomenon or the vertical crosstalk effect may be avoided because of the coupling effect of the voltages of the data lines on the two sides. It should be particularly noted that because the human eyes are highly sensitive to the green light spectrum, when the luminous characteristic of the green sub-pixels is in a normal state and even when the vertical crosstalk phenomenon merely occurs in the red sub-pixels or the blue sub-pixels, the quality or color uniformity of an image displayed by the display panel 100 is approximately normal to the human eyes. On the contrary, if the luminous characteristic of the green sub-pixels is abnormal, the quality of the image displayed by the display panel 100 is degraded. Therefore, with the polarization sequence 'positive-negative-positive-positive-negative-positive-negative-negative' used in FIG. 7, the polarities of the sub-pixels can be directly inverted according to a column inversion algorithm in the pixel array PA.

If the polarization sequence 'positive-negative-negative-positive-negative-positive-positive-negative' in FIG. 6 is used in the display panel 100, the data lines having the same polarity may be found on two sides of some green sub-pixels in the pixel array PA. For example, the data line D3 on the other side of the green sub-pixel coupled to the gate line G1 and the data line D2 (in the negative polarity) also has the negative polarity. The data line D7 on the other side of the green sub-pixel coupled to the gate line G1 and the data line D6 (in the positive polarity) also has the positive polarity. Therefore, as for each of these green sub-pixels in the duration of one image frame, the coupling voltage in one polarity of the data line on one side and the coupling voltage in the same polarity of the data line on the other side are superposed, and the average value of the driving voltages of the green sub-pixels changes. For example, when the data lines on two sides of some green sub-pixel in the pixel array PA have the positive polarity, if the polarity of the sub-pixel is inverted by using the column inversion algorithm, the driving voltage is increased; thus, the abnormal brightening phenomenon of the sub-pixel or the vertical crosstalk effect appears due to the coupling effect of the voltages of the data lines on the two sides. To improve the vertical crosstalk effect, if the polarization sequence 'positive-negative-negative-positive-negative-positive-positive-negative' in FIG. 6 is used in the display panel 100, the polarities of the sub-pixels have to be inverted by using the N-line dot inversion algorithm. In the embodiments, the column inversion algorithm is defined in a way that when the polarities of the sub-pixels are inverted in the pixel array PA, all the sub-pixels coupled to the same data line (column sub-pixels) have the same polarity, and the polarities of the sub-pixels in the same column are inverted in a next frame. In the N-line dot inversion algorithm, every N sub-pixels on the same data line forms one set; the sub-pixels in the same set have the same polarity, and the sub-pixels in different sets may have different polarities. For example, as for the sub-pixels in the same column that are coupled to the data line D1 in FIG. 6, if the 2-line dot inversion (N=2) is used, among the sub-pixels in the same column that are coupled to the data line D1, the sub-pixels coupled to the gate line G1 and the gate line G2 are operated as a set in one polarity (for example, remaining in the positive polarity), and the sub-pixels coupled to the gate line G3 and the gate line G4 are operated as a set in the other polarity (for example, the negative polarity). In the embodiment, the pixel array PA in FIG. 6 becomes the pixel array PA in FIG. 8 after the 2-line dot inversion is performed. The details are described below.

Figure 8:
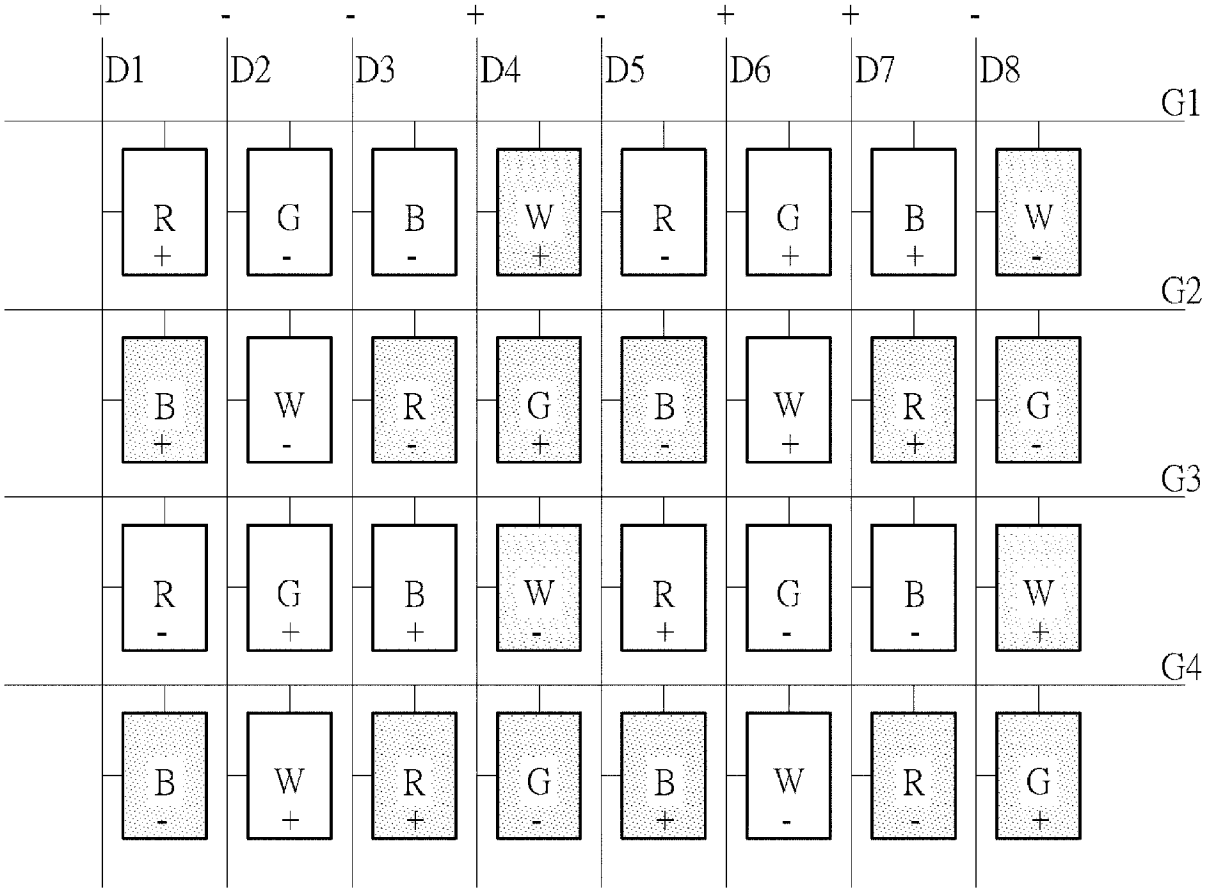
FIG. 8 is a schematic view of using a 2-line dot inversion algorithm when the first type of polarization sequence with a cycle being 8 is used in the display panel.

FIG. 8 is a schematic view of using a 2-line dot inversion algorithm when the first type of polarization sequence with a cycle being 8 is used in the display panel. As shown in FIG. 8, the sub-pixels coupled to the gate line G1 and the gate line G2 correspond to the polarities set in the polarization sequence; The sub-pixels coupled to the gate line G3 and the gate line G4 correspond to the opposite polarities set in the polarization sequence. For example, the data line D6 will output the voltage of a positive-polarity high-luminance sub-pixel, the voltage of a positive-polarity high-luminance sub-pixel, the voltage of a negative-polarity high-luminance sub-pixel, and the voltage of a negative-polarity high-luminance sub-pixel sequentially. The data line D7 will output the voltage of a positive-polarity high-luminance sub-pixel, the voltage of a positive-polarity low-luminance sub-pixel, the voltage of a negative-polarity high-luminance sub-pixel, and the voltage of a negative-polarity low-luminance sub-pixel sequentially. Therefore, although the driving voltage of each green sub-pixel between the data line D6 and the data line D7 fluctuates due to different polarities of the voltages of the data lines on two sides, the average driving voltage of the green sub-pixels between the data line D6 and the data line D7 is nearly equal to the voltage without being affected by the vertical crosstalk effect. In other words, if the polarization sequence 'positive-negative-negative-positive-negative-positive-positive-negative' in FIG. 6 is used in the display panel 100, the polarities of the sub-pixels need to be inverted by using the N-line dot inversion algorithm, such that the average value of the driving voltages of the sub-pixels having the data lines in the same polarity on two sides remains unchanged, thus improving the vertical crosstalk effect. It should be particularly noted that, as mentioned above, even if the N-line dot inversion algorithm is used, the driving voltage of each sub-pixel having the data lines in the same polarity on two sides still fluctuates (but the average value is fixed), and such a fluctuation has a cycle width. Therefore, to completely eliminate the vertical crosstalk effect, the liquid crystal molecules in the display panel 100 are made to be not able to respond to such voltage fluctuation in time. In the present embodiment, if a 60-Hertz specification of ultra-high resolution (UHD) is selected in the display panel 100, the value of N in the N-line dot inversion algorithm needs to be smaller than 64.9. In other words, N may be a numerical value in a range of 1 to 64 in the above condition.

Therefore, if the pixel array PA designed in FIG. 1 is adopted in the display panel 100 and the arrangement manner of the colors and the configuration manner of the bright/dark positions of the sub-pixels in the pixel array PA are also the same as the manner described in FIG. 1, the display panel 100 may have a uniform hue and uniform brightness distribution. Moreover, the horizontal crosstalk effect can be effectively improved by using a polarization sequence with a cycle being greater than or equal to 8, such as a polarization sequence of 'positive-negative-negative-positive-negative-positive-positive-negative' or 'positive-negative-positive-positive-negative-positive-negative-negative'. However, in some polarization sequences with a cycle being greater than or equal to 8, such as a polarization sequence of 'positive-negative-positive-positive-negative-positive-negative-negative', the data lines on two sides of each green sub-pixel have different polarities; therefore, no severe vertical crosstalk effect occurs in the display panel 100. In this condition, the column inversion algorithm can be directly used in the display panel 100 to invert the polarities of the sub-pixels. However, in some polarization sequence with a cycle being greater than or equal to 8, such as a polarization sequence of 'positive-negative-negative-positive-negative-positive-positive-negative', the data lines on two sides of some green sub-pixels have the same polarity, resulting in severe vertical crosstalk effect. Therefore, in this condition, the N-line dot inversion algorithm needs to be used in the display panel 100 to invert the polarities of the sub-pixels, thereby improving the vertical crosstalk effect.

Figure 9:
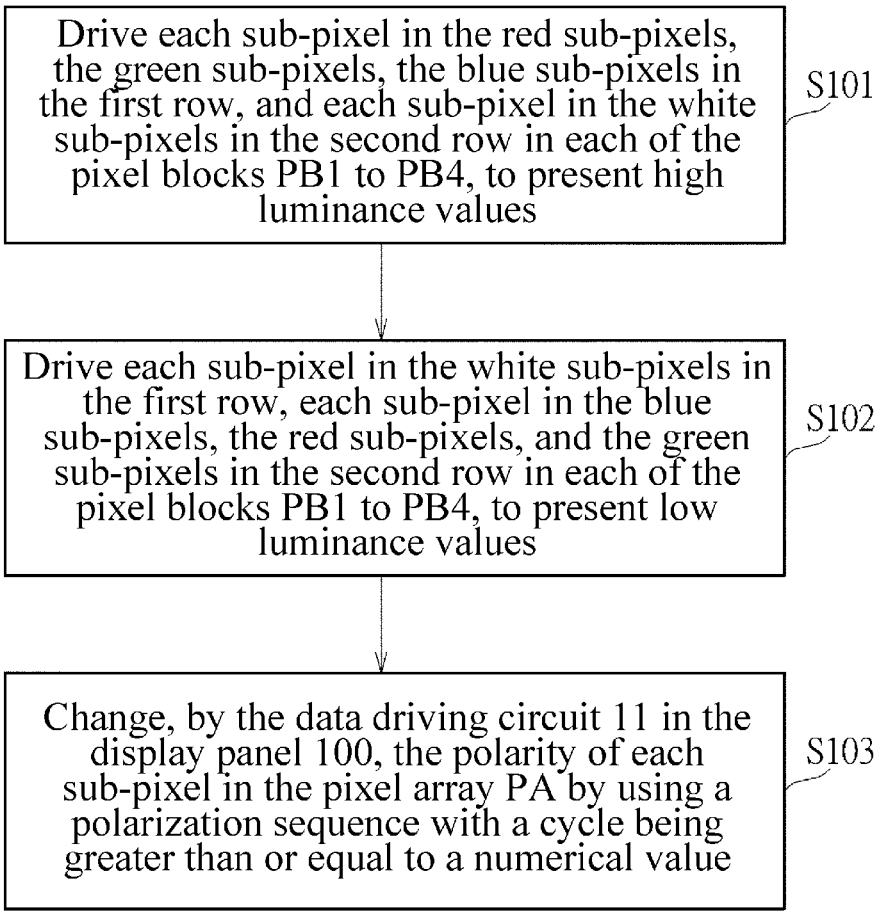
FIG. 9 is a flow chart of steps for driving the display panel.

To provide a more detailed description, the steps for driving the display panel 100 are described below. The steps for driving the display panel 100 include Step S101 to Step S103, as shown in FIG. 9.

Step S101: driving each sub-pixel in the red sub-pixels, the green sub-pixels, the blue sub-pixels in the first row, and each sub-pixel in the white sub-pixels in the second row in each of the pixel blocks PB1 to PB4, to present high luminance values.

Step S102: driving each sub-pixel in the white sub-pixels in the first row, each sub-pixel in the blue sub-pixels, the red sub-pixels, and the green sub-pixels in the second row in each of the pixel blocks PB1 to PB4, to present low luminance values.

Step S103: changing, by the data driving circuit 11 in the display panel 100, the polarity of each sub-pixel in the pixel array PA by using a polarization sequence with a cycle being greater than or equal to a numerical value.

The mechanism of achieving a uniform display hue and reducing the side-view color washout effect in Step S101 and Step S102 has been illustrated in detail above. Step S101 and Step S102 may also be performed as follows: driving the red sub-pixels in the first row (such as the sub-pixel P1 in FIG. 2A), the green sub-pixels in the first row (such as the sub-pixel P2 in FIG. 2A), the blue sub-pixels in the first row (such as the sub-pixel P3 in FIG. 2A), and the white sub-pixels in the second row (such as the sub-pixel P6 in FIG. 2A) in each pixel block based on the first gamma function Cuv1; and driving the white sub-pixels in the first row (such as the sub-pixel P4 in FIG. 2A), the blue sub-pixels in the second row (such as the sub-pixel P5 in FIG. 2A), the red sub-pixels in the second row (such as the sub-pixel P7 in FIG. 2A), and the green sub-pixels in the second row (such as the sub-pixel P8 in FIG. 2A) in each pixel block based on the second gamma function Cuv2, wherein the first gamma function Cuv1 and the second gamma function Cuv2 are predefined such that, when the first gamma function Cuv1 and the second gamma function Cuv2 are respectively provided to drive the corresponding sub-pixels to display a specified gray-scale value, a first luminance of the corresponding sub-pixels driven based on the first gamma function Cuv1 to display the specified gray-scale value is greater than a second luminance of the corresponding sub-pixels driven based on the second gamma function Cuv2 to display the specified gray-scale value, as shown in FIG. 2B. At some extreme gray-scale values mentioned above, the luminance of the sub-pixels driven based on the first gamma function Cuv1 is nearly equal to the luminance of the sub-pixels driven based on the second gamma function Cuv2. However, the first gamma function Cuv1 may be a gamma function corresponding to the side-viewing angle, and the second gamma function Cuv2 may be a gamma function corresponding to the front-viewing angle. Therefore, after the relative luminance of the sub-pixels in the display panel 100 is properly designed, the curve of the first gamma function Cuv1 is suppressed, and the side-view color washout effect is reduced. Moreover, Step S103 may also have two scenarios. The first scenario is that, when some gate sequences with a cycle being greater than or equal to 8 are used in the display panel 100 and the data lines on two sides of each green sub-pixel do not have the same polarity, an additional step may be performed on the display panel 100; that is, the polarities of the sub-pixels are inverted by using the column inversion algorithm. The second scenario is that, when some gate sequences with a cycle being greater than or equal to 8 are used in the display panel 100 and the data lines on two sides of some green sub-pixels have the same polarity, an additional step may be performed on the display panel 100; that is, the polarities of the sub-pixels are inverted by using the N-line dot inversion algorithm. Therefore, by means of the display panel 100 driven by Step S101 to Step S103, the side-view color washout effect can be reduced, and the horizontal crosstalk effect and the vertical crosstalk effect can also be reduced to the greatest extent.

In view of the certain embodiments mentioned above, those embodiments provide a display panel that can improve the side-view color washout effect, and discloses the color configuration manner and/or brightness configuration manner of the sub-pixels in the pixel array in the display panel. By means of the color configuration manner and/or brightness configuration manner of the sub-pixels, the display panel can display an image with the maximum hue uniformity. Further, to reduce the horizontal crosstalk effect, a polarization sequence with a cycle being greater than a numerical value may also be introduced into the display panel. To further reduce the vertical crosstalk effect, the N-line dot inversion algorithm may be introduced into the display panel to invert the polarities of the sub-pixels. Therefore, by means of the display panel of the certain embodiments, the display hue is uniform, the side-view color washout effect is reduced, and the horizontal crosstalk effect and the vertical crosstalk effect are also reduced to the greatest extent.

The above description only provides exemplary embodiments. The technical content of the present invention is disclosed through the foregoing preferable embodiments; however, these embodiments are not intended to limit the present invention. Various changes and modifications made by persons of ordinary skill in the art without departing from the spirit and scope of the present invention shall fall within the protection scope of the present invention. The protection scope of the present invention is subject to the appended claims.

What is claimed is:

1. A display panel, comprising:

a pixel array, comprising:

a plurality of pixel blocks, each of the plurality of pixel blocks comprising a plurality of sub-pixels;

a plurality of gate lines, each of the plurality of gate lines being electrically coupled to the sub-pixels in a same row of the pixel array; and a plurality of data lines, each of the plurality of data lines being electrically coupled to the sub-pixels in a same column of the pixel array;

a gate driving circuit, electrically coupled to the gate lines and configured to drive the sub-pixels in the pixel array; and a data driving circuit, electrically coupled to the data lines and configured to provide data signals to the sub-pixels in the pixel array, wherein the sub-pixels in each of the plurality of pixel blocks comprise a first sub-pixel, a second sub-pixel, a third sub-pixel, and a fourth sub-pixel sequentially arranged in one row in a first direction and a fifth sub-pixel, a sixth sub-pixel, a seventh sub-pixel, and an eighth sub-pixel sequentially arranged in another row in the first direction; the first and fifth sub-pixels are arranged in the same column, the second and sixth sub-pixels are arranged in the same column, the third and seventh sub-pixels are arranged in the same column, and the fourth and eighth sub-pixels are arranged in the same column; the first, second, third, and sixth sub-pixels are driven based on a first gamma function, and the fourth, fifth, seventh, and eighth sub-pixels are driven based on a second gamma function; and wherein the first sub-pixel is a first red sub-pixel, the second sub-pixel is a first green sub-pixel, the third sub-pixel is a first blue sub-pixel, the fourth sub-pixel is a first white sub-pixel, the fifth sub-pixel is a second blue sub-pixel, the sixth sub-pixel is a second white sub-pixel, the seventh sub-pixel is a second red sub-pixel, and the eighth sub-pixel is a second green sub-pixel.

2. The display panel according to claim 1, wherein:

a luminance value of each of the first to fourth sub-pixels is greater than that of each of the fifth to eighth sub-pixels; and the data driving circuit is configured to change a polarity of each of the plurality of sub-pixels in the pixel array through the data lines by using a polarization sequence with a cycle being greater than or equal to a numerical value, wherein the cycle of the polarization sequence is greater than or equal to 8, and the data lines on a left and a right side of each of a plurality of green sub-pixels in the pixel array have different polarities.

3. The display panel according to claim 2, wherein the sequentially-arranged sub-pixels from left to right in the first row of each of the plurality of pixel blocks comprise the first red sub-pixel having a first polarity, the first green sub-pixel having a second polarity, the first blue sub-pixel having the first polarity, and the first white sub-pixel having the first polarity, and the sequentially-arranged sub-pixels from left to right in the second row of each of the plurality of pixel blocks are the second blue sub-pixel having the first polarity, the second white sub-pixel having the second polarity, the second red sub-pixel having the first polarity, and the second green sub-pixel having the first polarity.

4. The display panel according to claim 2, wherein the sequentially-arranged sub-pixels from left to right in the first row of each of the plurality of pixel blocks comprise the first red sub-pixel having a first polarity, the first green sub-pixel having the first polarity, the first blue sub-pixel having a second polarity, and the first white sub-pixel having the first polarity, and the sequentially-arranged sub-pixels from left to right in the second row of each of the plurality of the pixel blocks are the second blue sub-pixel having the first polarity, the second white sub-pixel having the first polarity, the second red sub-pixel having the second polarity, and the second green sub-pixel having the first polarity.

5. The display panel according to claim 2, wherein the polarities of the sub-pixels in the pixel array are inverted using a column inversion algorithm.

6. The display panel according to claim 1, wherein the data driving circuit is further configured to change a polarity of each of the plurality of sub-pixels using a polarization sequence having a cycle being greater than or equal to 8, the data lines on a left and a right side of some of the first or second green sub-pixels have the same polarity, and the polarities of the sub-pixels in the pixel array are inverted using an N-line dot inversion algorithm, wherein N is a positive integer of a power of 2, and N is smaller than or equal to 64.

7. The display panel according to claim 6, wherein the polarization sequence is a polarization sequence having the cycle of a first polarity, a second polarity, the second polarity, the first polarity, the second polarity, the first polarity, the first polarity, and the second polarity;

the sub-pixels from left to right in a first row of the pixel array comprise a red sub-pixel having the first polarity, a green sub-pixel having the second polarity, a blue sub-pixel having the second polarity, a white sub-pixel having the first polarity, a red sub-pixel having the second polarity, a green sub-pixel having the first polarity, a blue sub-pixel having the first polarity, and a white sub-pixel having the second polarity; and the sub-pixels from left to right in a second row of the pixel array comprise a blue sub-pixel having the first polarity, a white sub-pixel having the second polarity, a red sub-pixel having the second polarity, a green sub-pixel having the first polarity, a blue sub-pixel having the second polarity, a white sub-pixel having the first polarity, a red sub-pixel having the first polarity, and a green sub-pixel having the second polarity.

8. A display panel, comprising:

a pixel array, comprising:

a plurality of pixel blocks, each of the plurality of pixel blocks comprising a plurality of sub-pixels;

a plurality of gate lines, each of the plurality of gate lines being electrically coupled to the sub-pixels in the same row of the pixel array; and a plurality of data lines, each of the plurality of data lines being electrically coupled to the sub-pixels in the same column of the pixel array;

a gate driving circuit, electrically coupled to the gate lines and configured to drive the sub-pixels in the pixel array; and a data driving circuit, electrically coupled to the data lines and configured to providing data signals to the sub-pixels in the pixel array, wherein the sub-pixels in each of the plurality of pixel blocks comprise a first sub-pixel, a second sub-pixel, a third-sub pixel, and a fourth sub-pixel sequentially arranged in one row in a first direction and a fifth sub-pixel, a sixth sub-pixel, a seventh sub-pixel, and an eighth sub-pixel sequentially arranged in another row in the first direction; the first and fifth sub-pixels are arranged in the same column, the second and sixth sub-pixels are arranged in the same column, the third and seventh sub-pixels are arranged in the same column, and the fourth and eighth sub-pixels are arranged in the same column; the first, second, third, and sixth sub-pixels are driven based on a first gamma function, and the fourth, fifth, seventh, and eighth sub-pixels are driven based on a second gamma function; and wherein the first gamma function and the second gamma function are predefined such that, when the first gamma function and the second gamma function are respectively provided to drive the corresponding sub-pixels to display a specified gray-scale value, a first luminance of the corresponding sub-pixels driven based on the first gamma function to display the specified gray-scale value is greater than a second luminance of the corresponding sub-pixels driven based on the second gamma function to display the specified gray-scale value.

9. The display panel according to claim 8, wherein the first sub-pixel is a first red sub-pixel, the second sub-pixel is a first green sub-pixel, the third sub-pixel is a first blue sub-pixel, the fourth sub-pixel is a first white sub-pixel, the fifth sub-pixel is a second blue sub-pixel, the sixth sub-pixel is a second white sub-pixel, the seventh sub-pixel is a second red sub-pixel, and the eighth sub-pixel is a second green sub-pixel.

10. The display panel according to claim 9, wherein the data lines on a left and a right side of each of the plurality of green sub-pixels in each of the plurality of pixel blocks have different polarities.

11. The display panel according to claim 9, wherein the data lines on a left and a right side of some of the first or second green sub-pixels in each pixel block have the same polarity.

12. The display panel according to claim 9, wherein in each of the plurality of pixel blocks, the first sub-pixel is adjacent to the second sub-pixel, the second sub-pixel is adjacent to the third sub-pixel, the third sub-pixel is adjacent to the fourth sub-pixel, the fifth sub-pixel is adjacent to the sixth sub-pixel, the sixth sub-pixel is adjacent to the seventh sub-pixel, and the seventh sub-pixel is adjacent to the eighth sub-pixel; and the sub-pixels in the first row of each of the plurality of pixel block are adjacent to the sub-pixels in a corresponding second row.

13. The display panel according to claim 8, wherein in each of the plurality of pixel blocks, the first sub-pixel is adjacent to the second sub-pixel, the second sub-pixel is adjacent to the third sub-pixel, the third sub-pixel is adjacent to the fourth sub-pixel, the fifth sub-pixel is adjacent to the sixth sub-pixel, the sixth sub-pixel is adjacent to the seventh sub-pixel, and the seventh sub-pixel is adjacent to the eighth sub-pixel; and the sub-pixels in the first row of each of the plurality of pixel block are adjacent to the sub-pixels in a corresponding second row.

14. A method for driving a display panel, wherein the display panel comprises a pixel array, the pixel array comprises a plurality of pixel blocks, the method comprising:

driving a first sub-pixel, a second sub-pixel, a third sub-pixel, and a sixth sub-pixel in each of the plurality of pixel blocks based on a first gamma function; and driving a fourth sub-pixel, a fifth sub-pixel, a seventh sub-pixel, and an eighth sub-pixel in each of the plurality of pixel blocks based on a second gamma function, wherein in each of the plurality of pixel block, the first to fourth sub-pixels are sequentially arranged in one row in a first direction, the fifth to eighth sub-pixels are sequentially arranged in another row in the first direction; the first and fifth sub-pixels are arranged in a first column, the second and sixth sub-pixels are arranged in a second column, the third and seventh sub-pixels are arranged in a third column, and the fourth and eighth sub-pixels are arranged in a forth column.

15. The method according to claim 14, further comprising:

changing a polarity of each of the plurality of sub-pixel in the pixel array using a polarization sequence having a cycle being greater than or equal to a numerical value.

16. The method according to claim 15, further comprising:

inverting the polarities of the sub-pixels according to a column inversion algorithm, wherein the cycle of the polarization sequence is greater than or equal to 8, and wherein the data lines on a left and a right side of each green sub-pixel in the pixel array have different polarities.

17. The method according to claim 15, further comprising:

inverting the polarities of the sub-pixels in the pixel array using an N-line dot inversion algorithm, wherein the cycle of the polarization sequence is greater than or equal to 8, and wherein the data lines on a left and a right side of some green sub-pixels in the pixel array have the same polarity.

18. The method according to claim 14, wherein a first row of each of the plurality of pixel block comprises a first red sub-pixel, a first green sub-pixel, a first blue sub-pixel, and a first white sub-pixel sequentially arranged from left to right, and a second row of each of the plurality of pixel blocks comprises a second blue sub-pixel, a second white sub-pixel, a second red sub-pixel, and a second green sub-pixel sequentially arranged from left to right.

* * * * *